US007828527B2

(12) United States Patent
Smith et al.

(10) Patent No.: US 7,828,527 B2
(45) Date of Patent: Nov. 9, 2010

(54) PAINT CIRCULATING SYSTEM AND METHOD

(75) Inventors: Alan A. Smith, Staffordshire (GB); Nigel C. Wood, Staffordshire (GB); Michael A. Thomas, Belleville, MI (US)

(73) Assignee: Illinois Tool Works Inc., Glenview, IL (US)

( * ) Notice: Subject to any disclaimer, the term of this patent is extended or adjusted under 35 U.S.C. 154(b) by 871 days.

(21) Appl. No.: 11/225,723

(22) Filed: Sep. 13, 2005

(65) Prior Publication Data

US 2007/0075163 A1 Apr. 5, 2007

(51) Int. Cl.
*F04B 49/00* (2006.01)

(52) U.S. Cl. ..... 417/26

(58) Field of Classification Search ..... 417/26; 183/663; 239/124, 76; 427/8; 137/563; 118/667, 692, 688; 222/318
See application file for complete search history.

(56) References Cited

U.S. PATENT DOCUMENTS

| | | | | |
|---|---|---|---|---|
| 2,244,686 | A | 6/1941 | Garrison et al. | |
| 3,720,373 | A | 3/1973 | Levey | |
| 3,730,773 | A * | 5/1973 | Graber | 138/46 |
| 3,816,025 | A | 6/1974 | O'Neill | |
| 3,939,855 | A | 2/1976 | Wiggins | |
| 3,958,724 | A * | 5/1976 | Ordway | 222/318 |
| 3,981,320 | A | 9/1976 | Wiggins | |
| 4,005,825 | A | 2/1977 | Schowiak | |
| 4,009,971 | A | 3/1977 | Krohn et al. | |
| 4,019,653 | A | 4/1977 | Scherer et al. | |
| 4,062,220 | A | 12/1977 | Taube et al. | |
| 4,085,892 | A | 4/1978 | Dalton | |
| 4,116,259 | A * | 9/1978 | Koskimies et al. | 162/380 |
| 4,215,721 | A | 8/1980 | Hetherington et al. | |
| 4,231,382 | A | 11/1980 | Allibert | |
| 4,231,392 | A | 11/1980 | Allibert | |
| 4,232,055 | A | 11/1980 | Shaffer | |
| 4,265,858 | A | 5/1981 | Crum et al. | |

(Continued)

FOREIGN PATENT DOCUMENTS

| | | |
|---|---|---|
| EP | 1830966 | 5/2008 |

(Continued)

OTHER PUBLICATIONS

Search report dated Nov. 24, 2006 for PCT/US2006/030176.

(Continued)

*Primary Examiner*—Devon C Kramer
*Assistant Examiner*—Christopher Bobish
(74) *Attorney, Agent, or Firm*—Fletcher Yoder

(57) ABSTRACT

A paint circulating system is suitable for providing paint to applicators in a product finishing facility. The system includes a pump for pumping paint around the system and a back-pressure regulator (BPR), which substantially eliminates pressure fluctuations of paint in the system upstream of the BPR. A controller is provided for controlling the pump and the BPR to operate in one of a flow mode, wherein a required flow rate of paint around the system is maintained, and a pressure mode, wherein a pressure of paint between the pump and the BPR is maintained. The paint circulating method includes switching operation of the pump and the BPR between the flow mode and the pressure mode.

33 Claims, 3 Drawing Sheets

U.S. PATENT DOCUMENTS

| | | | | |
|---|---|---|---|---|
| 4,281,683 | A | 8/1981 | Hetherington et al. | |
| 4,295,489 | A | 10/1981 | Arends et al. | |
| 4,311,724 | A | 1/1982 | Scharfenberger | |
| 4,313,475 | A | 2/1982 | Wiggins | |
| 4,337,282 | A | 6/1982 | Springer | |
| 4,348,425 | A | 9/1982 | Scharfenberger | |
| 4,350,720 | A | 9/1982 | Scharfenberger | |
| 4,375,865 | A | 3/1983 | Springer | |
| 4,376,523 | A | 3/1983 | Goyen | |
| 4,380,321 | A | 4/1983 | Culbertson et al. | |
| 4,390,126 | A | 6/1983 | Buchholz et al. | |
| 4,397,610 | A | 8/1983 | Krohn | |
| 4,487,367 | A | 12/1984 | Perry et al. | |
| 4,497,341 | A | 2/1985 | Wright | |
| 4,509,684 | A | 4/1985 | Schowiak | |
| 4,545,401 | A * | 10/1985 | Karpis | 137/487 |
| 4,549,572 | A | 10/1985 | Wright | |
| 4,569,480 | A * | 2/1986 | Levey | 239/135 |
| RE032,151 | E | 5/1986 | Scharfenberger | |
| 4,592,305 | A | 6/1986 | Scharfenberger | |
| 4,593,360 | A | 6/1986 | Cocks | |
| 4,627,465 | A | 12/1986 | Kolibas et al. | |
| 4,653,532 | A * | 3/1987 | Powers | 137/563 |
| 4,657,047 | A | 4/1987 | Kolibas | |
| 4,660,771 | A | 4/1987 | Chabert et al. | |
| 4,700,896 | A | 10/1987 | Takeuchi et al. | |
| 4,706,885 | A | 11/1987 | Morin | |
| 4,714,179 | A | 12/1987 | Otterstetter et al. | |
| 4,728,034 | A | 3/1988 | Matsumura et al. | |
| 4,750,523 | A * | 6/1988 | Crouse | 138/30 |
| 4,776,368 | A | 10/1988 | Drozd | |
| 4,785,760 | A | 11/1988 | Tholome | |
| 4,792,092 | A | 12/1988 | Elberson et al. | |
| 4,813,603 | A | 3/1989 | Takeuchi et al. | |
| 4,828,218 | A | 5/1989 | Medlock | |
| 4,830,055 | A | 5/1989 | Kolibas | |
| 4,844,706 | A | 7/1989 | Katsuyama et al. | |
| 4,846,226 | A | 7/1989 | Merritt | |
| 4,878,622 | A | 11/1989 | Jamison et al. | |
| 4,881,563 | A | 11/1989 | Christian | |
| 4,884,752 | A | 12/1989 | Plummer | |
| 4,902,352 | A | 2/1990 | Christian | |
| 4,909,180 | A | 3/1990 | Oishi et al. | |
| 4,915,599 | A | 4/1990 | Katsuyama et al. | |
| 4,917,296 | A | 4/1990 | Konieczynski | |
| 4,928,883 | A | 5/1990 | Weinstein | |
| 4,936,340 | A * | 6/1990 | Potter et al. | 137/487.5 |
| 4,936,507 | A | 6/1990 | Weinstein | |
| 4,936,509 | A | 6/1990 | Weinstein | |
| 4,936,510 | A | 6/1990 | Weinstein | |
| 4,957,060 | A | 9/1990 | Cann | |
| 4,962,724 | A | 10/1990 | Prus et al. | |
| 4,982,903 | A | 1/1991 | Jamison et al. | |
| 4,993,353 | A | 2/1991 | Ogasawara et al. | |
| 5,014,645 | A | 5/1991 | Cann et al. | |
| 5,033,942 | A | 7/1991 | Petersen | |
| 5,058,805 | A | 10/1991 | Anderson et al. | |
| 5,058,812 | A | 10/1991 | Cox et al. | |
| 5,064,680 | A | 11/1991 | Cann et al. | |
| 5,072,881 | A | 12/1991 | Taube, III | |
| 5,074,237 | A | 12/1991 | Ogasawara | |
| 5,094,596 | A | 3/1992 | Erwin et al. | |
| 5,096,120 | A | 3/1992 | Luckarz | |
| 5,096,126 | A | 3/1992 | Giroux et al. | |
| 5,100,057 | A | 3/1992 | Wacker et al. | |
| 5,102,045 | A | 4/1992 | Diana | |
| 5,102,046 | A | 4/1992 | Diana | |
| 5,146,950 | A | 9/1992 | Rodgers et al. | |
| 5,152,466 | A | 10/1992 | Matushita et al. | |
| 5,154,357 | A | 10/1992 | Jamison et al. | |
| 5,171,613 | A | 12/1992 | Bok et al. | |
| 5,192,595 | A * | 3/1993 | Akeel et al. | 427/421.1 |
| 5,193,750 | A | 3/1993 | LaMontagne et al. | |
| 5,195,680 | A | 3/1993 | Holt | |
| 5,196,067 | A | 3/1993 | Lacchia | |
| 5,197,676 | A | 3/1993 | Konieczynski et al. | |
| 5,199,650 | A | 4/1993 | Ishibashi et al. | |
| 5,205,488 | A | 4/1993 | Heusser | |
| 5,220,259 | A | 6/1993 | Werner et al. | |
| 5,221,047 | A | 6/1993 | Akeel | |
| 5,223,306 | A | 6/1993 | Bartow | |
| 5,228,842 | A | 7/1993 | Guebeli et al. | |
| 5,249,748 | A | 10/1993 | Lacchia et al. | |
| 5,255,856 | A | 10/1993 | Ishibashi et al. | |
| 5,269,567 | A | 12/1993 | Kubota et al. | |
| 5,271,569 | A | 12/1993 | Konieczynski et al. | |
| 5,306,350 | A | 4/1994 | Hoy et al. | |
| 5,309,403 | A | 5/1994 | Bartow | |
| 5,328,093 | A | 7/1994 | Feitel | |
| 5,336,063 | A | 8/1994 | Lehrke et al. | |
| 5,397,063 | A | 3/1995 | Weinstein | |
| 5,411,210 | A | 5/1995 | Gimple et al. | |
| 5,413,283 | A | 5/1995 | Gimple et al. | |
| 5,433,587 | A | 7/1995 | Bankert et al. | |
| 5,460,297 | A | 10/1995 | Shannon et al. | |
| 5,485,941 | A | 1/1996 | Guyomard et al. | |
| 5,549,755 | A | 8/1996 | Milovich et al. | |
| 5,632,816 | A | 5/1997 | Allen et al. | |
| 5,632,822 | A | 5/1997 | Knipe, Jr. et al. | |
| 5,676,756 | A | 10/1997 | Murate et al. | |
| 5,701,922 | A | 12/1997 | Knipe, Jr. et al. | |
| 5,725,150 | A | 3/1998 | Allen et al. | |
| 5,725,358 | A | 3/1998 | Bert et al. | |
| 5,746,831 | A | 5/1998 | Allen et al. | |
| 5,787,928 | A | 8/1998 | Allen et al. | |
| 5,853,027 | A | 12/1998 | Winkel et al. | |
| 5,854,190 | A | 12/1998 | Knipe, Jr. et al. | |
| 5,863,352 | A | 1/1999 | Gonda | |
| 5,865,380 | A | 2/1999 | Kazama et al. | |
| 5,944,045 | A | 8/1999 | Allen et al. | |
| 6,056,008 | A * | 5/2000 | Adams et al. | 137/487.5 |
| 6,077,354 | A | 6/2000 | Kaneski et al. | |
| 6,154,355 | A | 11/2000 | Alterburger et al. | |
| 6,168,824 | B1 | 1/2001 | Barlow et al. | |
| 6,305,419 | B1 * | 10/2001 | Krieger et al. | 137/625.6 |
| 6,382,220 | B1 | 5/2002 | Kefauver | |
| 6,423,143 | B1 | 7/2002 | Allen et al. | |
| 6,533,488 | B2 | 3/2003 | Blenkush et al. | |
| 6,612,345 | B1 | 9/2003 | Hosoda et al. | |
| 6,619,563 | B2 | 9/2003 | van der Steur | |
| 6,627,266 | B2 | 9/2003 | Dion | |
| 6,712,021 | B2 * | 3/2004 | Pollock | 119/72 |
| 6,712,906 | B2 | 3/2004 | Estelle et al. | |
| 6,722,257 | B2 | 4/2004 | Yoh et al. | |
| 6,755,913 | B1 | 6/2004 | Kobayashi et al. | |
| 6,821,096 | B2 | 11/2004 | Kosmyna et al. | |
| 6,976,072 | B2 * | 12/2005 | Mathieson | 709/224 |
| 7,026,365 | B2 | 4/2006 | Lee et al. | |
| 2003/0101931 | A1 | 6/2003 | Estelle et al. | |
| 2003/1019131 | | 6/2003 | Estelle | |
| 2004/0001765 | A1 | 1/2004 | Wood | |
| 2004/0030428 | A1 * | 2/2004 | Crampton et al. | 700/101 |
| 2004/0056045 | A1 | 3/2004 | Kosmyna et al. | |
| 2004/0154532 | A1 | 8/2004 | Ramsay | |
| 2005/0152789 | A1 | 7/2005 | Kapron | |
| 2006/0177565 | A1 * | 8/2006 | Bhattacharya et al. | 427/8 |
| 2006/0193731 | A1 | 8/2006 | Lendzion et al. | |
| 2007/0075163 | A1 | 4/2007 | Smith et al. | |
| 2007/0122555 | A1 | 5/2007 | Jones | |
| 2007/0207260 | A1 | 9/2007 | Collmer et al. | |

2008/0230128 A1 9/2008 Smith et al.

FOREIGN PATENT DOCUMENTS

| | | | |
|---|---|---|---|
| FR | 2 656 348 | A3 | 6/1991 |
| GB | 1 155 328 | | 6/1969 |
| GB | 1 155 328 | A | 6/1969 |
| JP | 05285436 | A | 2/1993 |
| JP | 2008012406 | | 1/2008 |
| TW | 520315 | | 2/2003 |
| TW | 570841 | | 1/2004 |
| WO | 2005/061889 | A1 | 7/2005 |
| WO | 2005/075793 | A1 | 8/2005 |
| WO | 2007/031841 | A2 | 3/2007 |
| WO | WO2007029094 | | 3/2007 |
| WO | WO2007031841 | | 3/2007 |
| WO | WO2007032827 | | 3/2007 |

OTHER PUBLICATIONS

Xu and Koelling, "Development of a Closed Loop Paint Circulation System for Non-Newtonian Waterborne Coatings", 2006 SAE World Congress Apr. 3-6, 2006, Detroit Michigan.

* cited by examiner

PAINT CIRCULATING SYSTEM AND METHOD

The present invention relates to a paint circulating system and method, of a type suitable for use with automated spray finishing processes.

BACKGROUND OF THE INVENTION

Traditional paint spray systems, of the type employed in car manufacturing for example, usually consist of several separate paint lines, each providing a different coloured paint to a spray booth for distribution to a number of user points (e.g. spray applicators). In general, only one colour is sprayed or in use at any one time, so only one line is actively employed whilst the rest remain ready for use.

When a system is not in use because the paint is not being sprayed, it is usual to maintain the spraying pressure and paint velocity in the paint line, by pumping paint from a paint tank around a circuit and back to the tank. This is done for two reasons: firstly, because the liquid paint must be kept moving, otherwise pigmentation may start to settle out in the paint lines; secondly, because the lines must be primed to the required pressure before spraying commences. However, maintaining the lines at pressure is wasteful of energy.

To ensure that the paint is at the required pressure for spraying, a Back Pressure Regulator (BPR) is used in combination with the paint pump to regulate and maintain the required fluid pressure and flow at the spray booth. In conventional systems, the BPR is adjusted manually and uses a coil spring acting on a diaphragm to vary the width of a flow passage. This helps to maintain the paint pressure upstream of the BPR by controlling the fluid flow rate returning to the paint tank. Also, in many systems (such as those employing certain types of turbine or lobe pumps) the pump will be set to operate at a fixed pressure and flow rate and the BPR used to maintain the required system pressure. In this type of system, the BPR controls system pressure by adjusting flow rate to compensate for variations in the amount of fluid used at the spray booth. Thus, each line is usually operated in the condition required for spraying, whether the paint is being used or merely circulated. This is extremely inefficient and results a large waste of energy. For example, a system operating 24 hours a day may only be required to spray each individual colour, for, say, 1 hour a day. Each pump would be operated at the pressure and flow rate required to meet the system requirement for 24 hours a day even though the paint is not required to operate at the full system pressure and flow rate for 23 hours of the day.

In addition, a pump that is required to provide a higher flow rate and pressure for a longer period of time will suffer a higher rate of wear, requiring maintenance in a much shorter period of time than one that is used more sparingly.

It is an object of the present invention to provide a paint circulation system, which alleviates the aforementioned problems.

SUMMARY OF THE INVENTION

The paint circulating system according to the invention comprises a pump for pumping paint around the system, and a back-pressure regulator (BPR) to substantially eliminate pressure fluctuations of paint upstream of the BPR. Control means control the pump and the BPR to operate in one of a flow mode, wherein a required flow rate of paint around the system is maintained, and a pressure mode, wherein a pressure of paint between the pump and the BPR is maintained.

In embodiments of the invention, in the flow mode, the BPR is configured to be de-activated so as to allow paint to flow without varying the flow rate in response to pressure fluctuations. The BPR is preferably an automated type, whereby activation means such as compressed air or a hydraulic fluid is provided to activate and/or de-activate the BPR. The BPR may comprise a diaphragm that is acted upon by a spring or by fluid pressure on one side, and by the paint pressure on the other side. In the flow mode, the control means may be configured to control the pump so as to pump paint at a fixed flow rate. The fixed flow rate is preferably a low flow rate, at or just above a minimum flow rate required for the paint.

It is an advantage that the system is able to place the BPR and pump into the flow mode when pressurised paint is not required at the spray booth. In this flow mode there is no need to maintain a high paint pressure in the lines, and the pump can be operated at a steady, low flow rate to reduce energy consumption and wear.

In embodiments of the invention, when in the pressure mode, the BPR is configured to be activated so as to respond to variations in the paint pressure to maintain a substantially constant pressure upstream of the BPR. In the pressure mode, the pump is preferably configured to deliver paint at a predetermined pressure. The pump may be a variable speed, or variable capacity pump responsive to a control signal to maintain the predetermined pressure. A pressure sensor may be provided at the pump outlet, or other suitable position in the system, to provide a pressure signal as a basis for the control signal. The control means may be arranged to receive the pressure signal and to provide the control signal to the pump for maintaining the predetermined pressure.

It is an advantage that, when paint is required at the spray booth, the system can be placed into the pressure mode by activating (i.e. turning on) the BPR and operating the pump to deliver paint at a high pressure, thereby ensuring that the paint is delivered to the spray booth at the required flow rate and pressure.

In embodiments of the invention, the controller may be operable to switch the system between the flow mode and the pressure mode in response to a demand signal. The demand signal may be provided from a plant scheduling or 'job queue' data processing apparatus.

In one embodiment of the invention, the controller comprises a control card for mounting in a programmable controller or computer device. The control card is preferably provided with a plurality of input and output terminals for receiving signals from sensors in the system and for providing control signals to the BPR and the pump. The control card may be provided with a data link to a graphics system for set-up and monitoring purposes.

The control card may include a plurality of channels for controlling a plurality of paint circulating systems, each providing paint to a spray booth. Each of the plurality of paint circulating systems may provide a different colour of paint to the spray booth. It is an advantage that the system can operate in a manner that will allow the "job queue" data to control circulating system operating parameters. "Job queue" data is defined as the data collected by software that monitors the position of parts throughout an automotive OEM, Tier 1 or industrial plant once the parts have been loaded on a conveyor system. The job queue data may be used to provide demand signals to the colour valves to turn on and turn off the supply of paint to the applicators in the spray booth. In the same manner, with the system of the present invention, the job queue data can now be used to provide demand signals that automatically pressurize or de-pressurize the circulating system, depending on the needs at the applicator. This ability provides great savings with regard to paint wear (shear) energy usage and general pump component wear.

BRIEF DESCRIPTION OF THE DRAWINGS

Particular embodiments of the invention are illustrated in the accompanying drawings wherein:—

DESCRIPTION OF THE PREFERRED EMBODIMENT

Figure 1:
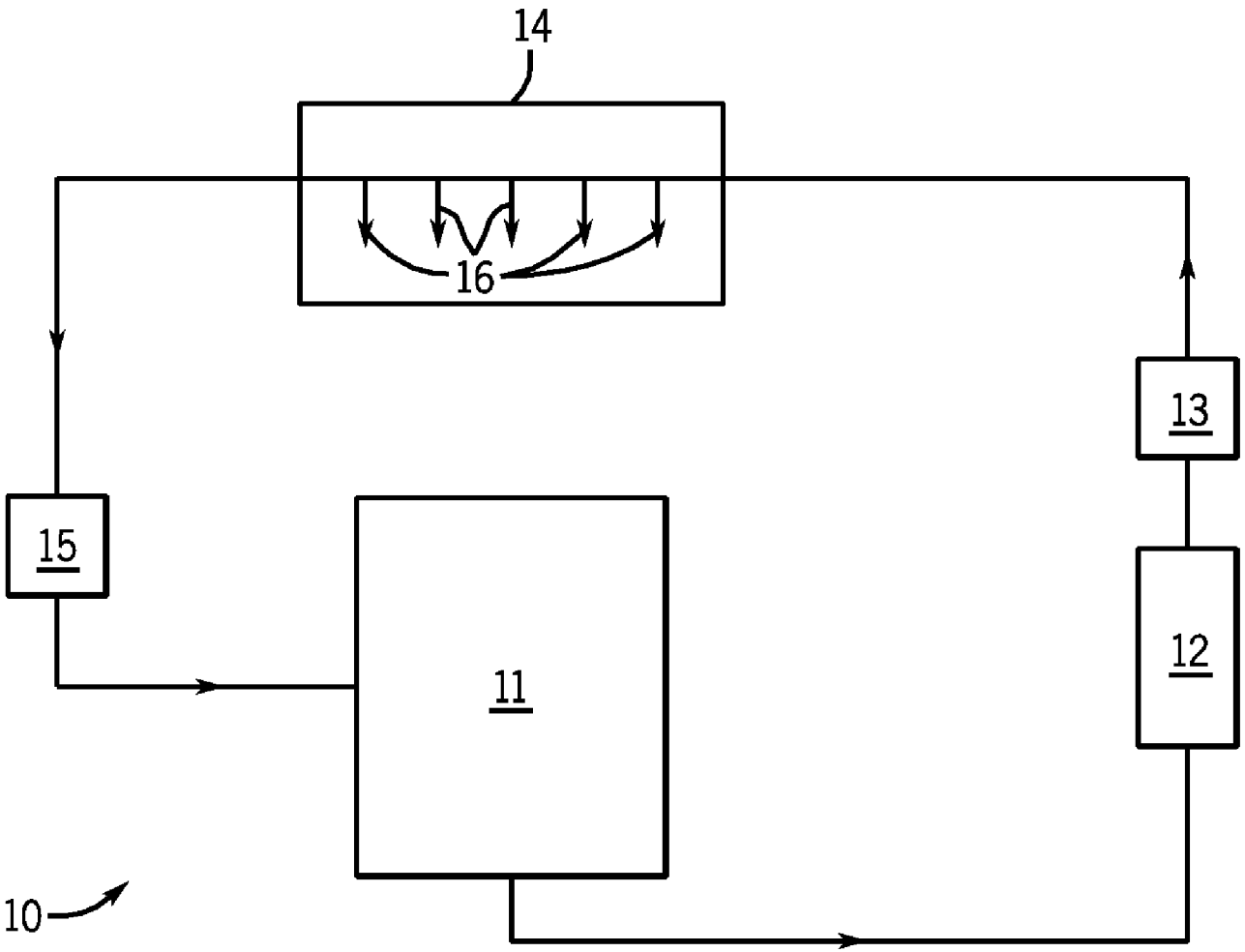
FIG. 1 PRIOR ART
FIG. 1 is a schematic representation of a known paint circulation system.

Referring to FIG. 1, a paint circulation system 10 includes a paint tank 11 containing a reservoir of liquid paint. A pump 12 is operable to supply paint from the paint tank 11, optionally through a paint filter 13, to a spray booth 14. The spray booth 14 typically includes one or more applicators 16. For example these may be spray nozzles manipulated by robot arms. Any unused paint flows past the spray booth and is returned to the paint tank 11 via a BPR 15.

In this set-up, the BPR 15 is employed to control the upstream pressure in the system at the desired level, typically 5 to 10 bar when the paint is in use. The BPR 15 typically includes a diaphragm, one side of which is acted upon by a coiled spring.

The pressure of paint entering the BPR 15 urges the diaphragm against the spring force to open up a passage for paint. Any reduction in paint pressure results in the diaphragm moving under the spring force, tending to close the passage. This acts as a restriction to the flow of paint, which means that a greater pressure drop occurs across the BPR 15 so that the upstream pressure is maintained. The spring force acting on the diaphragm is pre-set so that the BPR 15 acts to maintain a set upstream pressure.

The known circulating system of FIG. 1 is based on pump flow rates being set to provide the maximum flow demand from the paint take-offs (i.e. applicators 16), assuming all are in use at the same time. As paint line pressure drops due to paint usage, the BPR 15 closes to reduce the fluid flow returning to the paint tank 11 thus maintaining the desired line pressure.

Figure 2:
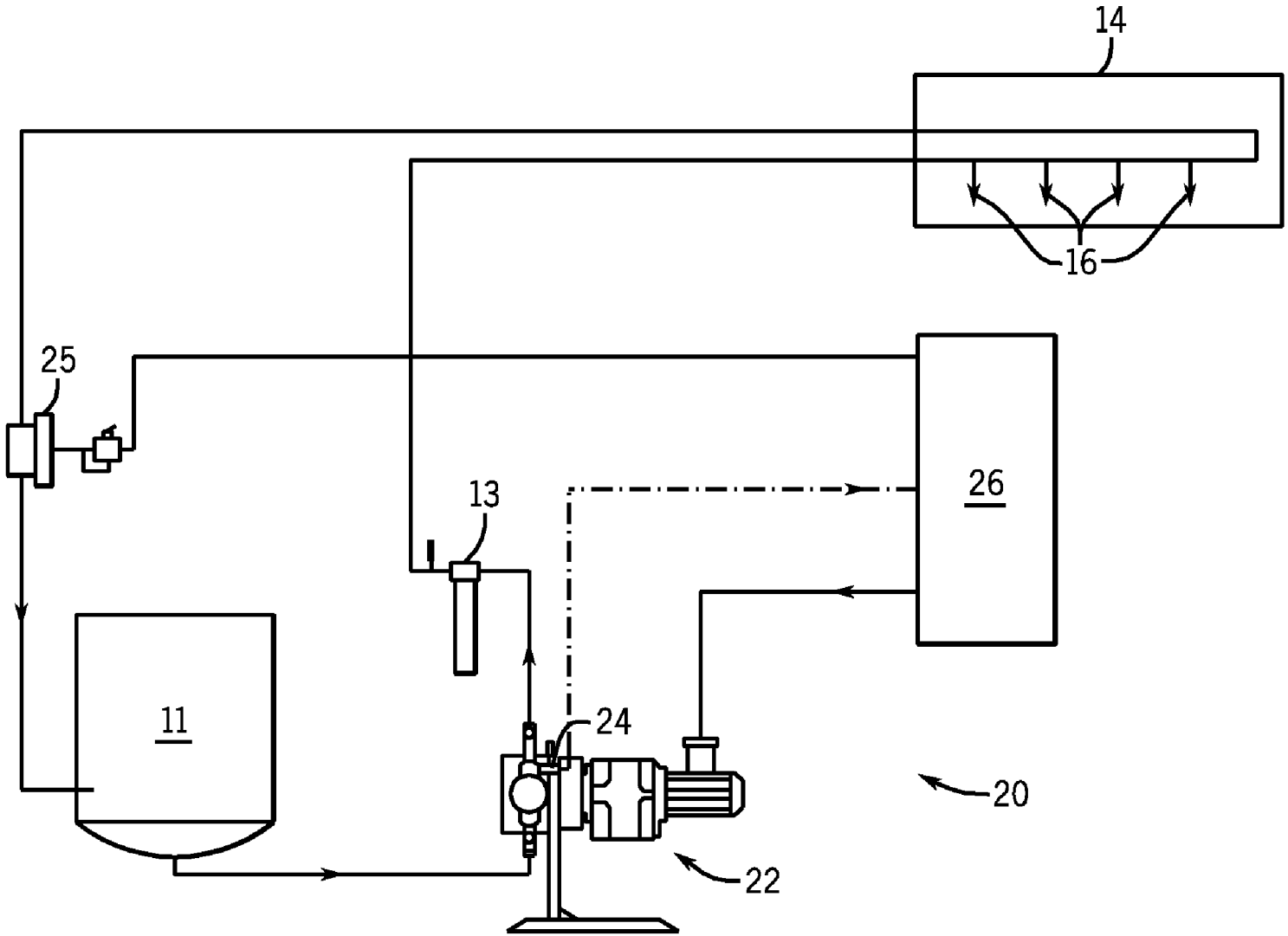
FIG. 2 is schematic representation of a paint circulation system according to the present invention.

Referring to FIG. 2, there is shown a system 20 according to the present invention, wherein equivalent components to those shown in FIG. 1 have the same reference numeral. In this case an electric variable speed pump 22, referred to hereafter as a smart pump, pumps the paint from the paint tank 11 to the spray booth 14. Although the smart pump described herein is an electric pump, it will be appreciated by those of skill in the art that alternative pumps may be used, for example air driven or hydraulically driven pumps. The smart pump 22 includes a pressure sensor 24. Paint not used in the spray booth 14 is circulated back to the paint tank 11 via an automatically controlled BPR 25, referred to hereafter as a smart BPR. The smart BPR is of a type that can be activated and de-activated by way of a suitable control mechanism, for example compressed air or hydraulic fluid. An example of such a regulator is described in the applicants' concurrently filed United Kingdom patent application entitled "Back Pressure Regulator", the contents of which are hereby incorporated by reference. The smart pump 22 and the smart BPR 25 are controlled from a controller 26. A signal from the pressure sensor 24 is provided as an input to the controller 26. The controller 26 may be a PLC or other suitable programmable device. In an exemplary embodiment, the controller comprises a smart card, as will be described in more detail below.

The controller 26 is configured to control the smart pump 22 and the smart BPR 25 so that these will operate in either a flow mode or a pressure mode. The mode may be determined from job queue data.

When paint is needed at the applicators 16 (as per job queue data), the system 20 will be operated in the pressure mode. The controller 26 will issue a command signal that will cause the smart BPR to be activated so that it will operate to maintain the upstream pressure according to a predetermined set pressure. The user will also have pre-set the desired system pressure into a memory of the controller 26, for example via a laptop or PC input during initial start up. The controller 26 is programmed to control the pump speed so that the pressure will be maintained, by means of a suitable control loop. The pressure sensor 24 transmits the actual pressure in the paint line to the controller 26, which reacts by using the control loop to output a signal that controls the speed of the smart pump 22. For example if the paint pressure drops in the line below the set pressure due to usage at the applicators 16, the pump 22 will speed up in order to maintain pressure. Note: The smart BPR 25 will initially dynamically reduce the amount of fluid returning to the paint tank 11 in order to maintain the set pressure. The smart pump 22 only speeds up once the BPR 25 can no longer maintain the system pressure.

When material is not in demand (as per job queue data) the system 20 will be operated in flow mode. The user will have input the minimum flow rate required to meet the desired minimum paint velocity as recommended by material supplier and the controller will control the smart pump 22 to operate at the speed required to provide this minimum flow rate. In addition the controller 26 will issue a command to de-activate the smart BPR 25. The smart BPR 25 will no longer operate to maintain the upstream pressure, so that the only system back pressure will be due to the pipework frictional resistance. Energy usage will now be at a minimum.

Figure 3:
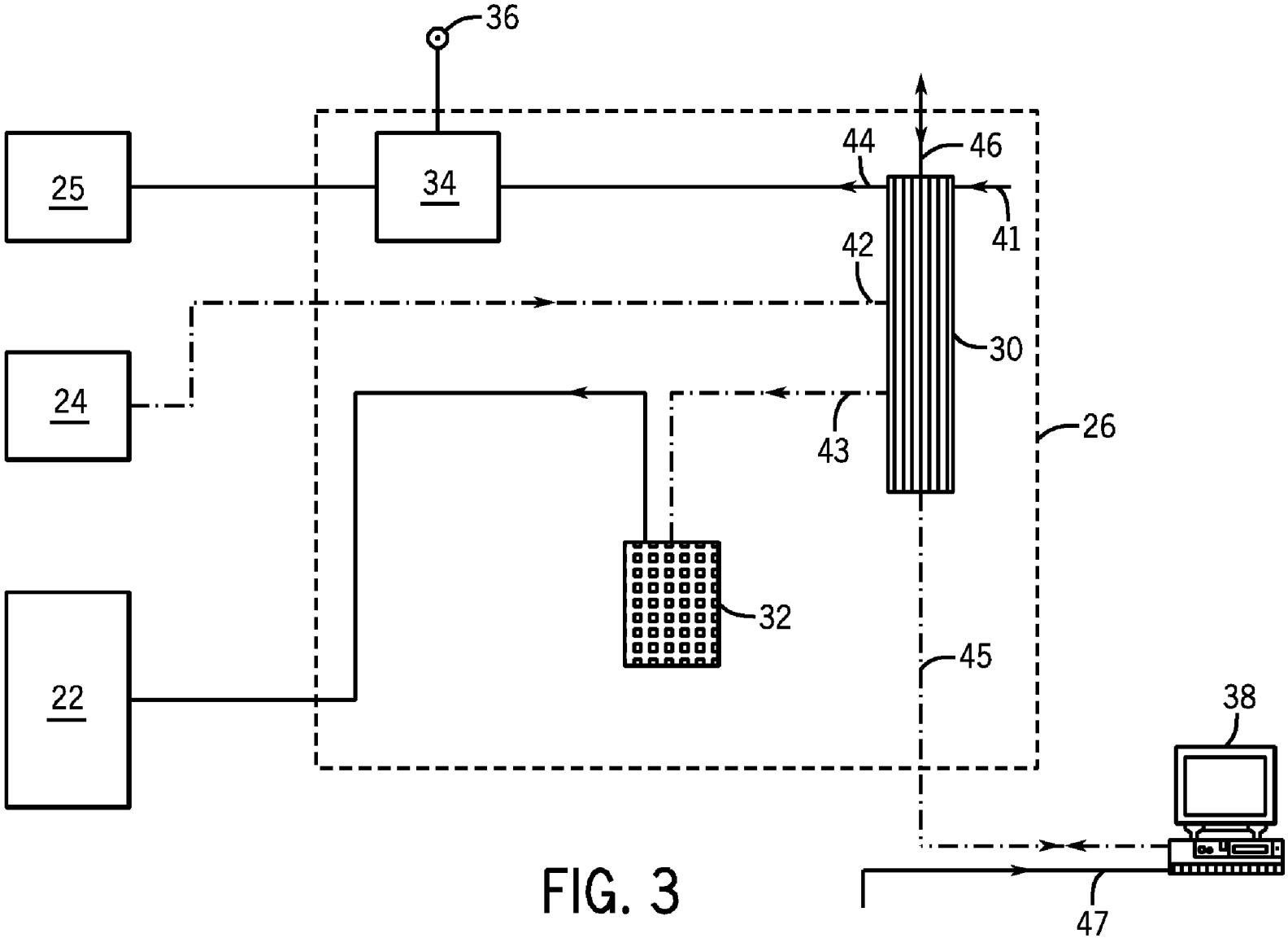
FIG. 3 is schematic representation of a controller for use in the paint circulation system of FIG. 2.

Referring to FIG. 3, more detail is shown of an exemplary controller 26 for controlling the smart pump 22 and smart BPR 25 of the system 20 of FIG. 2. This controller 26 includes a smart card 30. The smart card 30 typically comprises one or more printed circuit boards (PCBs) housed in a plastic carrier and mountable to a DIN rail in a purpose built or an existing control panel. The smart card 30 contains circuitry that includes a programmable memory and a processor. Alternatively, the smart card may include an interface for communicating with an external processor, for example a PLC or a computer. The smart card 30 may include a plurality (e.g. 8) channels, each channel on the card being used to control one of a number of paint lines, each of which may provide a different colour, feeding the spray booth. Each channel on the smart card 30 includes a number of input/output terminals. These include:

- A digital input 41 for receiving a system mode signal
- An input 42 for receiving a signal (e.g. 4-20 mA) from the pressure sensor 24
- An output 43 for providing a signal (e.g. 4-20 mA) corresponding to a frequency to an AC frequency inverter 32 for controlling the speed of the smart pump 22
- An output 44 (e.g. capable of driving 24 v at 50 mA) for controlling the switching of a valve 34 for connecting/disconnecting a supply of compressed air 36 to the smart BPR 25.

In addition, the smart card 30 is provided with a serial communications link 45. This is used as a data link to a computer 38 (e.g. a PC or a lap-top) that includes a graphics system for use in setting up the smart card, and for monitoring, data-logging and display of system parameters. The computer 38 may also receive data via one or more inputs 47 relating to other operating parameters of the system, for example differential pressures across the paint filter 13, or level indicators on the paint tank 11. The smart card 30 may also be provided with a further data link 46 to another, similar smart card, so that a plurality of smart cards may be cascaded in a single control system.

In use, set point values are inputted to the smart card 30 at initial start up via the communications link 45 from the laptop or PC 38. Job queue data from the software that monitors the position of parts being conveyed through the plant reports which paint system (i.e. which colour) needs to be in readiness for production, this data will be received by the smart card 30 to control the smart pump 22 and smart BPR 25 accordingly. The job queue data is transmitted to the smart card 30 by CCR LAN to the monitoring PC 38 or by digital input 41.

The memory on the smart card 30 includes a programmed control algorithm that defines the control loop for the operation of the smart pump 22 in response to the sensed pressure from the pressure sensor 24, when the system is operating in pressure mode.

Sequence of Operation:

- Material is not in use (Job Queue load data shows no immediate need for paint)
  - Smart pump 22 operates in flow mode. A: preset frequency setting is equal to the low flow rate required to maintain the specified minimum paint velocity.
  - The smart BPR 25 is fully unloaded (de-activated).
  - The system operates at the lowest recommended flow rate with the only pressure being that required to overcome the paint line pressure loss. Therefore paint shear, energy usage and pump wear are at a minimum.
- Material will be needed shortly (before color will be required at the applicators). Information is automatically provided by the job queue load data.
  - The smart BPR 25 is activated to provide the pre-set system pressure.
  - The smart pump 22 is switched to pressure mode. The pressure setting is preset and the controller 26 will operate the smart pump 22 in accordance with the control loop according to the pressure senses at the pressure sensor 24.
- Material is no longer needed (after color is no longer needed at the spraybooth)
  - The smart pump 22 is switched to flow mode. The preset frequency setting is equal to flow rate required to maintain minimum paint velocity in the line.
  - The smart BPR is fully unloaded (de-activated).

It will be recognised that the in the pressure mode, the control of the paint pressure at the spray booth results from a combination of the operation of the smart pump 22 and the smart BPR 25. Table 1 shows an example of how the paint flow rates provided by the smart pump 22 and through the smart BPR 25 might change as different amounts of paint are taken out through the applicators 16. In this example there are five applicators, designated A1, A2, A3, A4 and A5. Four different rates of paint usage are shown.

In condition 1, the system has been switched into the pressure mode, but there is not yet any paint being taken out through the applicators. The smart pump provides a flow rate of 9 L/min to ensure the required paint pressure at the applicators, and all of this flow circulates around the system through the smart BPR.

In condition 2, two applicators are spraying at a rate of 2 L/min, while one is spraying at 1 L/min and the other two are not spraying. The total amount being taken out is 5 L/min. In this condition, instead of the flow through the BPR dropping to 4 L/min and the smart pump continuing to provide a flow of 9 L/min, the amount of paint circulating through the smart BPR has only dropped to 6 L/min, while the smart pump has increased its speed to provide a flow of 11 L/min.

Similarly in condition 3, all the applicators are taking out 2 L/min each (a total of 10 L/min), while the smart pump has increased its speed to deliver 13 L/min, and the amount circulating back through the BPR has dropped to 3 L/min. This means that the smart BPR is still controlling the upstream pressure, even though the amount of paint being taken out is more than was originally being provided. The pressure of paint at the spray booth will therefore continue to be maintained by the smart BPR when there in a subsequent increase in the amount being sprayed.

In condition 4, the applicators are spraying at their maximum capacity of 3 L/min each (a total of 15 L/min). In this case there is no need to provide any flow through the smart BPR as there can be no further increase in the amount of paint being taken out of the system. The smart BPR therefore closes the line back to the paint tank and all the flow is provided from the smart pump (15 L/min).

TABLE 1

| Condition | A1 L/min | A2 L/min | A3 L/min | A4 L/min | A5 L/min | Pump flow L/min | BPR flow L/min |
|---|---|---|---|---|---|---|---|
| 1 | 0 | 0 | 0 | 0 | 0 | 9 | 9 |
| 2 | 0 | 2 | 2 | 1 | 0 | 11 | 6 |
| 3 | 2 | 2 | 2 | 2 | 2 | 13 | 3 |
| 4 | 3 | 3 | 3 | 3 | 3 | 15 | 0 |

- If the system pressure drops due to demand at the applicators 16 the BPR 25 will dynamically close in order to maintain pressure. If the BPR 25 can no longer maintain system pressure the smart pump 22 will automatically speed up, thus maintaining the pressure at the set point.
- The system will continue to operate in this mode until the job queue data shows that the paint material is no longer needed.

We claim:

1. A paint circulating system suitable for providing paint to applicators in a product finishing facility, the system comprising: a pump for pumping paint around the system; a back-pressure regulator operable in an activated state to substantially eliminate pressure fluctuations of paint upstream of the back-pressure regulator, and operable in a deactivated state to enable paint flow without being responsive to pressure fluctuations, wherein the applicators are configured to dispense paint when the back-pressure regulator is operating in the activated state, and wherein the applicators are configured to not dispense paint when the back-pressure regulator is operating in the deactivated state; and a controller comprising circuitry configured to provide one or more electronic control signals for controlling the pump and the back-pressure regulator to operate in one of a flow mode, wherein the back-pressure regulator is deactivated and a required flow rate of paint around the system is maintained, and a pressure mode, wherein the back-pressure regulator is activated and a pressure of paint between the pump and the back-pressure regulator is maintained.

2. The paint circulating system of claim 1, comprising an actuator to activate and/or deactivate the back-pressure regulator.

3. The paint circulating system of claim 2, wherein the actuator comprises compressed air.

4. The paint circulating system of claim 2, wherein the actuator comprises an hydraulic fluid.

5. The paint circulating system of claim 2, wherein the back-pressure regulator comprises a diaphragm that is acted upon by a spring on one side and by the paint pressure on the other side.

6. The paint circulating system of claim 2, wherein the back-pressure regulator comprises a diaphragm that is acted upon by fluid pressure on one side and by the paint pressure on the other side.

7. The paint circulating system of claim 1, wherein, in the flow mode, the controller is configured to control the pump to pump paint at a fixed flow rate.

8. The paint circulating system of claim 7, wherein the fixed flow rate is a low flow rate, at or just above a minimum flow rate required for the paint.

9. The paint circulating system of claim 1, wherein, in the pressure mode, the back-pressure regulator is configured to be activated to respond to variations in the paint pressure to maintain a substantially constant pressure upstream of the back-pressure regulator.

10. The paint circulating system of claim 1, wherein, in the pressure mode, the pump is configured to deliver paint at a predetermined pressure.

11. The paint circulating system of claim 10, wherein the pump is a variable speed pump responsive to a control signal to maintain the predetermined pressure.

12. The paint circulating system of claim 10, wherein the pump is a variable capacity pump responsive to a control signal to maintain the predetermined pressure.

13. The paint circulating system of claim 1, comprising a pressure sensor to provide a pressure signal as a basis for a control signal.

14. The paint circulating system of claim 13, wherein the controller is arranged to receive the pressure signal and to provide the control signal to the pump for maintaining the pressure when in the pressure mode.

15. The paint circulating system of claim 1, wherein the controller is operable to switch the system between the flow mode and the pressure mode in response to a demand signal.

16. The paint circulating system of claim 15, wherein the demand signal is provided from a plant scheduling apparatus.

17. The paint circulating system of claim 15, wherein the demand signal is provided from a 'job queue' data processing apparatus.

18. The paint circulating system of claim 1, wherein the controller comprises a control card configured to mount in a programmable computing device.

19. The paint circulating system of claim 18, wherein the control card is provided with a plurality of input and output terminals for receiving signals from sensors in the system and for providing control signals to the back-pressure regulator and the pump.

20. The paint circulating system of claim 18, wherein the control card is provided with a data link to a graphics system for set-up and monitoring purposes.

21. The paint circulating system of claim 18, wherein the control card includes a plurality of channels for controlling a plurality of paint circulating systems, each providing paint to a spray booth.

22. The paint circulating system of claim 21, wherein each of the plurality of paint circulating systems provides a different color of paint to the spray booth.

23. A paint circulating system for use in association with a paint spray-booth, the system comprising:

a variable speed pump for pumping paint around the system;

a back-pressure regulator operable in an active condition for varying a flow rate of paint in response to pressure fluctuations of paint flowing into the back-pressure regulator to maintain upstream paint pressure, and in an inactive condition wherein paint is free to flow through the back-pressure regulator; and a controller comprising circuitry configured to provide one or more electronic control signals for controlling the system to operate in one of a flow mode and a pressure mode;

wherein:

in the flow mode, the controller is configured to place the back-pressure regulator in the inactive condition and to operate the pump at a fixed speed to provide a required flow rate of paint around the system at a minimum pressure; and in the pressure mode, the controller is configured to place the back-pressure regulator in the active condition and to control the pump speed to maintain a pressure of paint at the spray booth, the controller being further operable to switch the system between the flow mode and the pressure mode in response to a demand signal.

24. A paint circulating system, comprising: a paint source; a paint application system comprising one or more applicators; a pump configured to circulate paint through the system; a back pressure regulator back-pressure regulator disposed downstream of the paint application system, wherein paint flowing through the paint application system that is not dispensed via the one or more applicators flows through the back-pressure regulator and returns to the paint source; and a controller configured to control the pump and the back-pressure regulator to selectively operate in one of a pressure mode and a flow mode, wherein: when in the pressure mode, the back-pressure regulator is active, and the back-pressure regulator and the pump operate together to maintain a pressure at the paint application system; and when in the flow mode, the back-pressure regulator is inactive, and the pump operates to maintain a flow rate of paint through the system.

25. The system of claim 24, wherein, when in the flow mode, the pump operates at a generally constant frequency corresponding to a desired flow rate of paint through the system.

26. The paint circulating system of claim 23, wherein the controller includes a plurality of channels for controlling a plurality of paint circulating systems, each providing paint to a spray booth.

27. A paint application system, comprising: a paint application booth having first and second sets of paint applicators; a first paint circulating system, comprising: a first paint source; a first pump configured to circulate paint through the first paint circulating system to the first set of paint applicators; and a first back pressure regulator back-pressure regulator disposed downstream of the paint application booth; a second paint circulating system, comprising: a second paint source; a second pump configured to circulate paint through the second paint circulating system to the second set of paint applicators; and a second back pressure regulator back-pressure regulator disposed downstream of the paint application booth; and a controller configured to control the first and second paint circulating systems, wherein controlling comprises operating each of the paint circulating systems in a flow mode or a pressure mode, and wherein: the flow mode of operating a desired paint circulating system comprises deactivating the back-pressure regulator associated with the desired paint circulating system and maintaining a required flow rate of paint through the desired paint circulating system via the pump associated with the desired paint circulating system; and the pressure mode of operating the desired paint circulating system comprises activating the back-pressure regulator associated with the desired paint circulating system and maintaining a pressure of paint between the pump associated with the desired paint circulating system and the back-pressure regulator associated with the desired paint circulating system, wherein the set of paint applicators corresponding to the desired paint circulating system is configured to dispense paint when the back-pressure regulator is activated, and wherein the set of paint applicators corresponding to the desired paint circulating system is configured to not dispense paint when the back-pressure regulator is deactivated.

28. The paint application system of claim 27, comprising first and second pressure sensors disposed in the first and second paint circulating systems, respectively, wherein each pressure sensor is configured to provide a pressure signal to the controller when the corresponding paint circulating system is in the pressure mode.

29. The paint application system of claim 27, wherein the controller is configured to control the first and second paint circulating systems based on signals received from a plant scheduling apparatus.

30. The paint application system of claim 27, wherein the controller is configured to control the first and second paint circulating systems based on signals received from a 'job queue' data processing apparatus.

31. The paint circulating system of claim 1, wherein the paint circulating system comprises: a second pump for pumping a second paint around the system; a second back-pressure regulator operable in activated state to substantially eliminate pressure fluctuations of the second paint upstream of the second back-pressure regulator, and operable in a deactivated state to enable a second paint flow without being responsive to pressure fluctuations, wherein the applicators are configured to dispense the second paint when the second back-pressure regulator is operating in the activated state, and wherein the applicators are configured to not dispense the second paint when the second back-pressure regulator is operating in the deactivated state; and the controller comprises circuitry to provide one or more electronic control signals for controlling the second pump and the second back-pressure regulator to operate in one of a second flow mode, wherein the second back-pressure regulator is deactivated and a second required flow rate of the second paint around the system is maintained, and a second pressure mode, wherein the second back-pressure regulator is activated and a second pressure of the second paint between the second pump and the second back-pressure regulator is maintained.

32. The paint circulating system of claim 1, wherein the controller comprises a programmable memory for storing a predetermined pressure at which to maintain the pressure of paint between the pump and the back-pressure regulator.

33. The system of claim 24, wherein the back-pressure regulator is disposed downstream of the one or more applicators.

* * * * *